US005839461A

United States Patent [19]

Lambeth, Jr.

[11] Patent Number: 5,839,461

[45] Date of Patent: Nov. 24, 1998

[54] PROTECTIVE APPARATUS FOR WALKERS AND OTHERS

[76] Inventor: Harvey F. Lambeth, Jr., P.O. Box 637, Bolton Landing, N.Y. 12814

[21] Appl. No.: 998,364

[22] Filed: Dec. 24, 1997

[51] Int. Cl.[6] ..... A61H 3/02

[52] U.S. Cl. ..... 135/72; 135/77; 362/102; 116/DIG. 44; 482/108; 222/192; 222/175; 222/113

[58] Field of Search ..... 135/65, 66, 72, 135/76; 116/DIG. 44; 222/39, 192, 175, 113; 362/96, 101, 102, 109, 205; 482/106, 108

[56] References Cited

U.S. PATENT DOCUMENTS

| | | | |
|---|---|---|---|
| 3,638,836 | 2/1972 | Vickers, III | 222/113 |
| 3,776,429 | 12/1973 | DeLucia | 222/192 X |
| 5,041,951 | 8/1991 | Fan | 362/102 |
| 5,086,377 | 2/1992 | Roberts | 362/102 |
| 5,219,402 | 6/1993 | Kondo et al. | 135/66 |
| 5,286,244 | 2/1994 | Wright et al. | 482/108 |
| 5,373,427 | 12/1994 | McLean | 362/96 |
| 5,446,985 | 9/1995 | Chen | 222/192 X |
| 5,476,192 | 12/1995 | Julinot | 116/DIG. 44 X |
| 5,477,431 | 12/1995 | Curameng, Jr. | 362/102 |
| 5,529,215 | 6/1996 | Banks et al. | 222/113 |
| 5,549,220 | 8/1996 | Whalen | 222/113 X |
| 5,556,003 | 9/1996 | Johnson et al. | 222/39 |
| 5,566,700 | 10/1996 | Brown | 135/72 |
| 5,582,196 | 12/1996 | Hae et al. | 135/65 |
| 5,683,168 | 11/1997 | Teig et al. | 362/96 |
| 5,709,635 | 1/1998 | Denison | 482/108 |
| 5,746,353 | 5/1998 | Cheok et al. | 222/192 X |

*Primary Examiner*—Lanna Mai
*Attorney, Agent, or Firm*—Charles A. Taylor

[57] ABSTRACT

A protective apparatus for walkers, hikers, and others incorporating a section containing a switchable combination alarm and incapacitating defensive fluid and incorporating a socket for attachment of a camera or lanyard, a storage section, a battery and electrical alarm section incorporating a socket for attachment of an optional walking stick and in a second variation a handle for use as part of a walking cane and in a third variation, an electrical prodding device in place of the storage section and contact points for the electrical prodding device extending from the battery and alarm section.

10 Claims, 10 Drawing Sheets

PROTECTIVE APPARATUS FOR WALKERS AND OTHERS

FIELD OF THE INVENTION

The present invention herein pertains to protective apparatus for use by walkers, joggers, hikers, security persons, and other users, and more particularly to such a protective apparatus having a section containing a switchable combination alarm and incapacitating defensive fluid spray and a socket for attachment of a camera or lanyard, a storage compartment or an optional electrical security prodding device, a battery compartment and a socket for attachment of an optional fixed or adjustable walking stick and in a second variation of a handle for use as part of a walking cane.

BACKGROUND OF THE INVENTION

Walking sticks and canes for walking, hiking and jogging may be made adjustable and retractable so as to fit different users of different heights. Because hiking, walking and jogging in some areas may be dangerous, there is a demand for both walking sticks or canes and a protective apparatus which is equipped with some means of providing warning signals and defensive fluid personal protection. Further, a person may have to take regular medicine, to carry medicine for emergency use, or need emergency protection from the weather, first aid supplies or personal items. It is helpful to provide hikers, walkers, joggers, and other users a protective apparatus having a storage chamber for keeping such medicine or personal items. In addition, it is helpful to provide an attachable adjustable walking stick or cane for persons needing some additional support when walking, hiking or jogging. As an alternative embodiment, it would be helpful to security persons in particular to have an electrical prodding device instead of a storage area.

Typically a walking stick or cane consists of familiar, expected and obvious structural configurations and designs developed for the fulfillment of numerous requirements and objectives. In some walking sticks or canes, the configurations have included illuminators or warning signals. Other personal protective apparatus have included devices containing warning alarms, defensive fluids, illuminators and other features such as pedometers and stop watches. Typically an electrical prodding device for use by security persons and others consists of an electrical prodder having two or more contacts points for contact with persons or animals and subsequent discharge of an electrical charge to cause a small electrical shock to the receiving person or animal.

Hae et al provides a multipurpose cane having a hollow handle and a retractable walking stick, wherein the hollow handle has a storage chamber and a lamp and battery means in U.S. Pat. No. 5,582,196. Brown in U.S. Pat. No. 5,556,700 discloses a walking stick having a stanchion assembly on the lower end to provide stability when walking on uneven ground. The Johnson et al U.S. Pat. No. 5,556,003 demonstrates a hand-held personal defense system including a striking bar and a defensive fluid means. In addition the Johnson apparatus may include an illumination light means, a stop watch and a pedometer. In U.S. Pat. No. 5,529,215 Banks provides a personal defense baton having a defensive fluid spraying means in the lower end of the baton.

It is apparent that the prior art does not provide a personal protective apparatus that is effective in urban, suburban and remote situations in which an attack against the individual hiker, jogger, walker, or others may occur. None of the devices alone adequately protect the user in those areas where the population may vary widely depending on the time when the area is entered. In general the devices do not include storage compartment for carrying personal items that may be needed by the user. The foregoing illustrates limitations known to exist in present personal protective devices and multiple purpose canes. Therefore it would be advantageous to provide a protective apparatus directed to overcoming one or more of the limitations set forth above. Accordingly, a suitable alternative is provided including features more fully disclosed hereinafter.

The protective apparatus of the present invention is particularly well suited for use by a user such as a hiker, a walker, a jogger, or others for protection against an attacker. It is also particularly well suited for carrying emergency items by the user such as medicines or protective items for weather changes. Further, it is well suited for use as a base for steadying a camera by the user. As an alternative embodiment with an integral electrical prodding device, it is well suited to security persons in particular.

SUMMARY OF THE INVENTION

In order to avoid the disadvantages of the related art, the present invention provides a protective apparatus for a hiker, walker, jogger, security person or other users in multiple situations where there may be some degree of danger. It is another purpose to provide a protective apparatus that includes a storage section to allow the walker, hiker, jogger, security person, or others to conveniently carry medicine for normal or emergency use, first aid items, car keys, protective items or gear for sudden weather changes or similar personal items.

It is still another object of the invention to provide hand activated protective apparatus including a hand activated alarm means and a defensive fluid means.

It is another purpose of the invention to provide a protective apparatus including a detachable walking stick or cane to provide support for the walker, hiker, jogger, or others. It is still another purpose to provide an embodiment with an integral electrical prodding device for use by security persons or others. According to the preferred embodiment of the present invention, the protective apparatus comprises a body containing a means for activating an alarm means and activating a defensive fluid means, a storage section, a section containing an electrical means for powering the alarm means, a section containing a defensive fluid means, and a connection means for a cane or walking stick.

DETAILED DESCRIPTION OF THE INVENTION

Referring now to the detailed drawings there is illustrated a protective apparatus in accordance with the present invention which demonstrates a hollow housing, generally designated as 10, in accordance with the preferred embodiment of the present invention, wherein like referenced numerals refer to like elements throughout the drawings.

Figure 1:
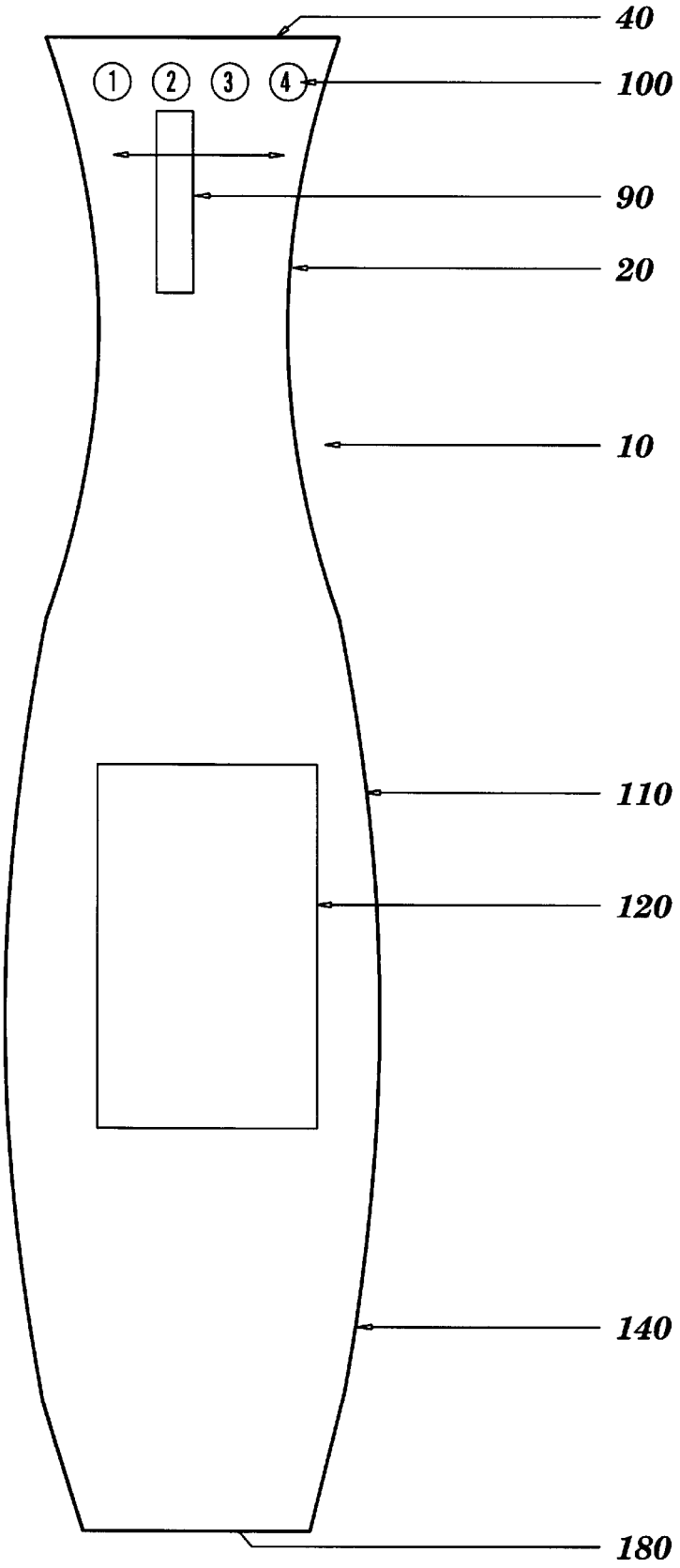
FIG. 1 is a plan view of a protective apparatus according to the preferred embodiment of the present intention showing the actuating means configured to operate in a direction perpendicular to the central axis of the personal protective apparatus.

The disclosure in FIG. 1 demonstrates the embodiment of the invention wherein the hollow housing 10 is preferably formed of hard rigid plastics such as polyethylene or polypropylene or fiberglass or lightweight metals such as rigid aluminum. The hollow housing 10 is comprised of an upper element 20, a middle element 110 and a lower element 140 and an upper end 40 and a lower end 180. As further disclosed in FIG. 1, the upper element 20, has an actuating means 90 which is slidably movable to any of four positions 100 on the circumference of upper element 20. FIG. 1 further discloses that the middle element 110 has a closeable opening 120 for access to an internal storage compartment.

Figure 2A:
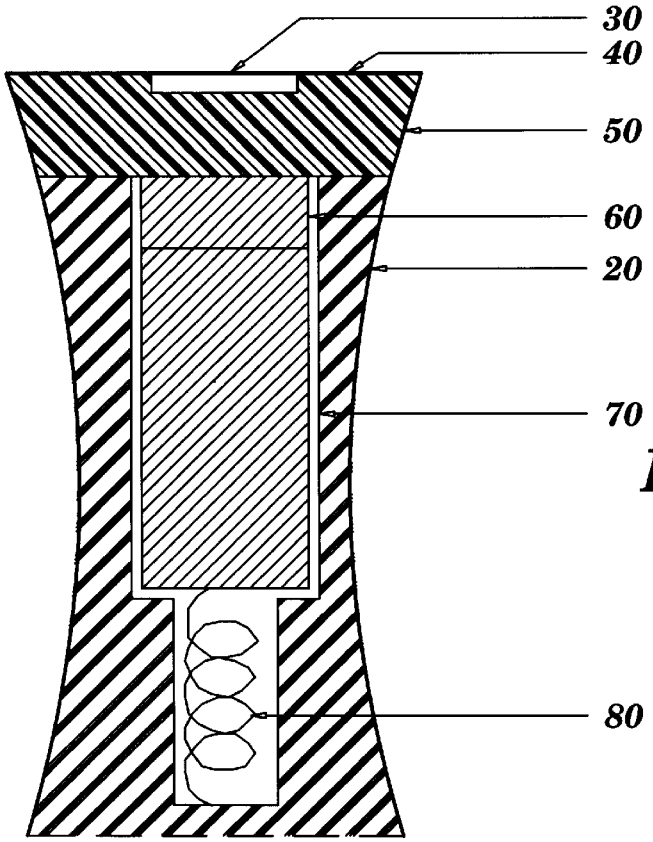
FIG. 2*a* is a partial section view of the upper element of the protective apparatus.

As disclosed in FIG. 2*a*, upper element 20 comprises a cover element 50 incorporating top end 40 and a hollow housing 70 for receiving defensive spray means 60. As shown in FIG. 2*a*, cover element 50 has a downwardly extending attachment means 30 for attaching items such as a camera or lanyard by the user. FIG. 2*a* further shows that defensive spray means 60 is held against cover 50 by compressed spring 80.

Figure 2B:
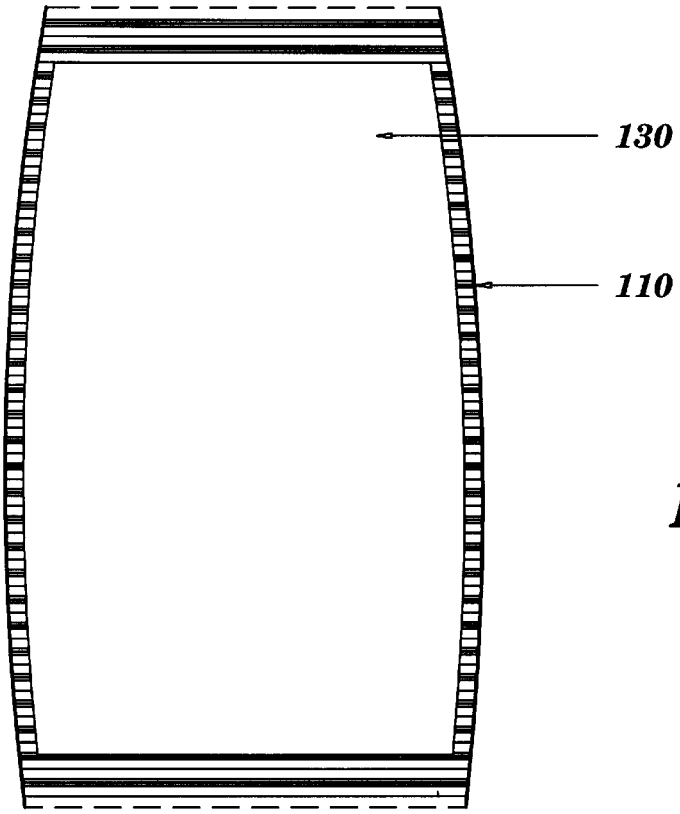
FIG. 2*b* is a partial section view of the middle element of the protective apparatus.

FIG. 2*b* discloses middle element 110 comprises a hollow housing 130 for storage of personal items by the user.

Figure 2C:
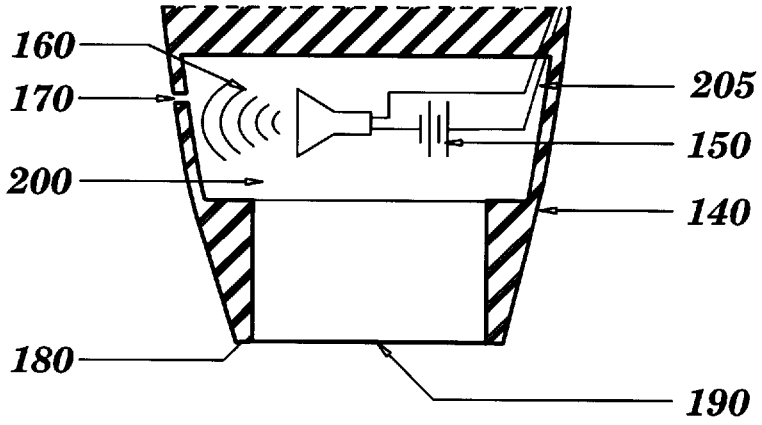
FIG. 2*c* is a partial section view of the lower element of the protective apparatus.

The disclosure in FIG. 2*c* demonstrates lower element 140 comprises a hollow housing 200. FIG. 2*c* further demonstrates a battery means 150 and a siren means 160 having an electrical connection means 205 for electrically connecting to the actuator means of the present invention. As further disclosed in FIG. 2*c*, lower element has at least one opening 170 defining a speaker grill. FIG. 2*c* further demonstrates an upwardly extending socket 190 in bottom end 190 for removably attaching a walking stick or cane stick.

Figure 3:
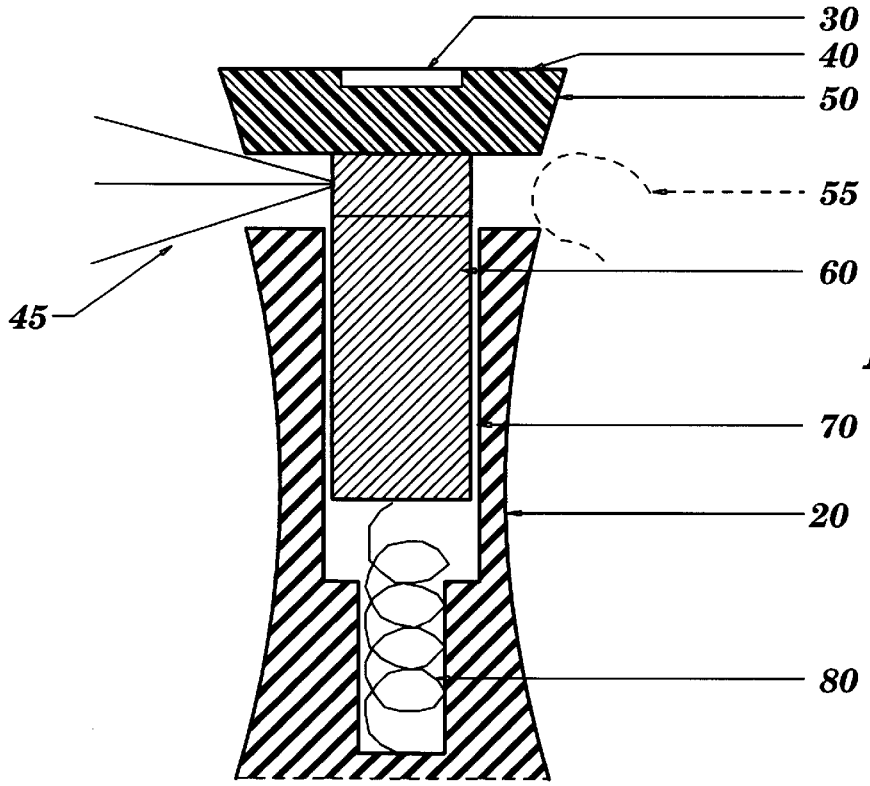
FIG. 3 is a sectional view of the upper element of the protective apparatus with the defensive fluid means in the position wherein the user can activate the defensive fluid means according to the present invention.

FIG. 3 discloses upper element 20 wherein the actuator means of the present invention has been moved to a position to free defensive fluid means 60. As demonstrated in FIG. 3, cover element 50 and defensive fluid means 60 are moved upward by compression spring 80. As further shown in FIG. 3, the users finger 55 activates the defensive fluid means releasing defensive fluid 45.

Figure 4:
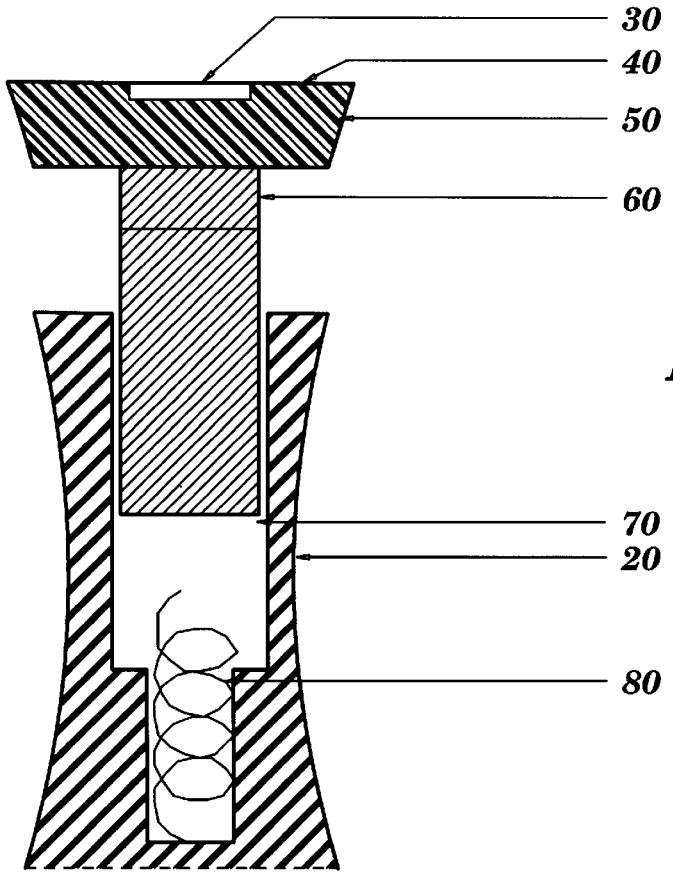
FIG. 4 is a sectional view of the upper element of the protective apparatus demonstrating the upper element in a position wherein the defensive fluid means can be removed and replaced.

As demonstrated in FIG. 4, movement of the actuator means to the load position allows the cover element 50 and the defensive fluid means to be removed from upper element 20 for replacement of the defensive fluid means.

Figure 5:
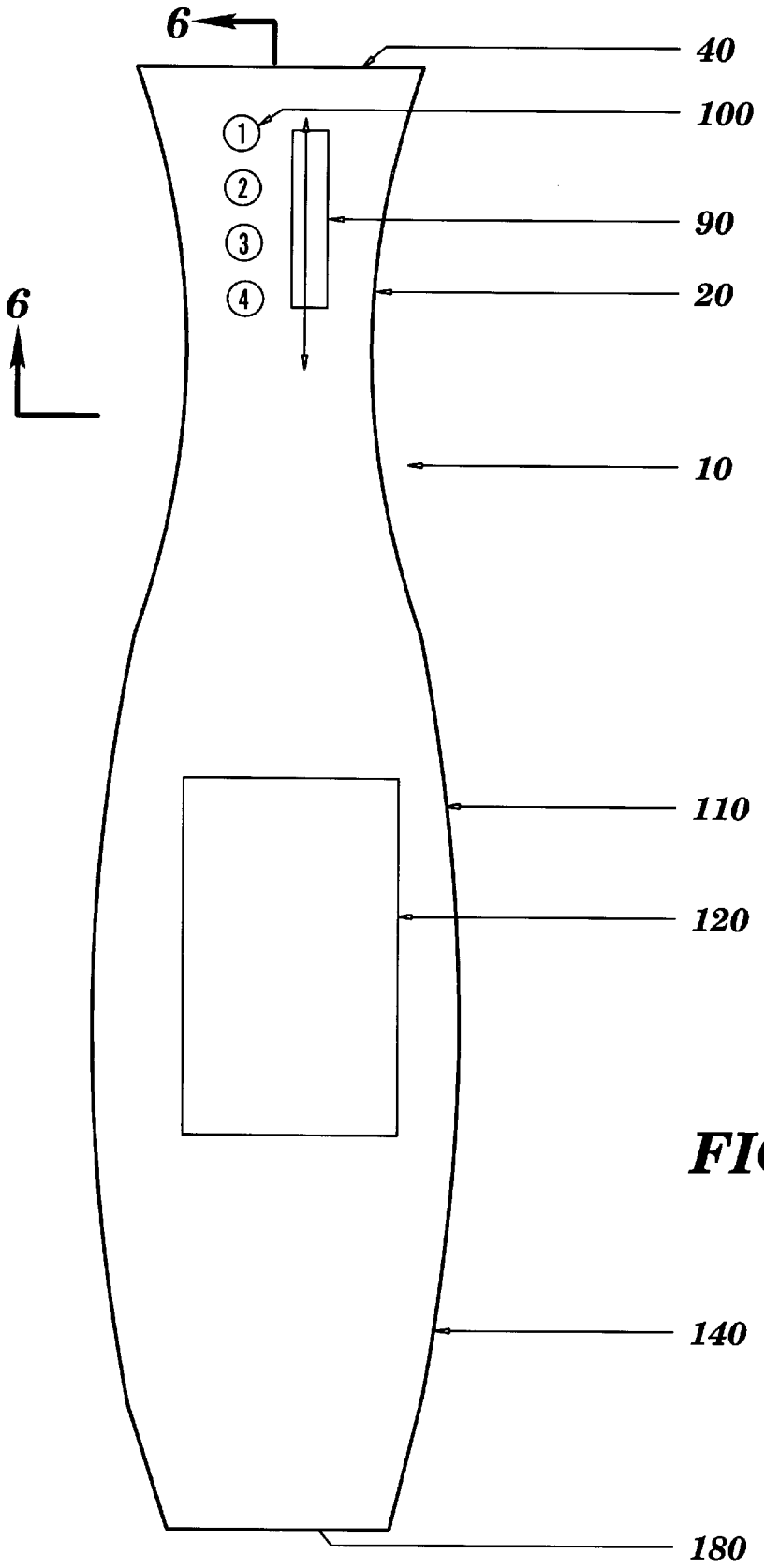
FIG. 5 is a plan view of an alternative embodiment showing the actuating means slidably operating in a direction parallel to the axis of the protective apparatus.

FIG. 5 demonstrates an alternative embodiment having an actuating means 90 which is slidably movable to any of four positions 100 along the axis of upper element 20.

Figure 6:
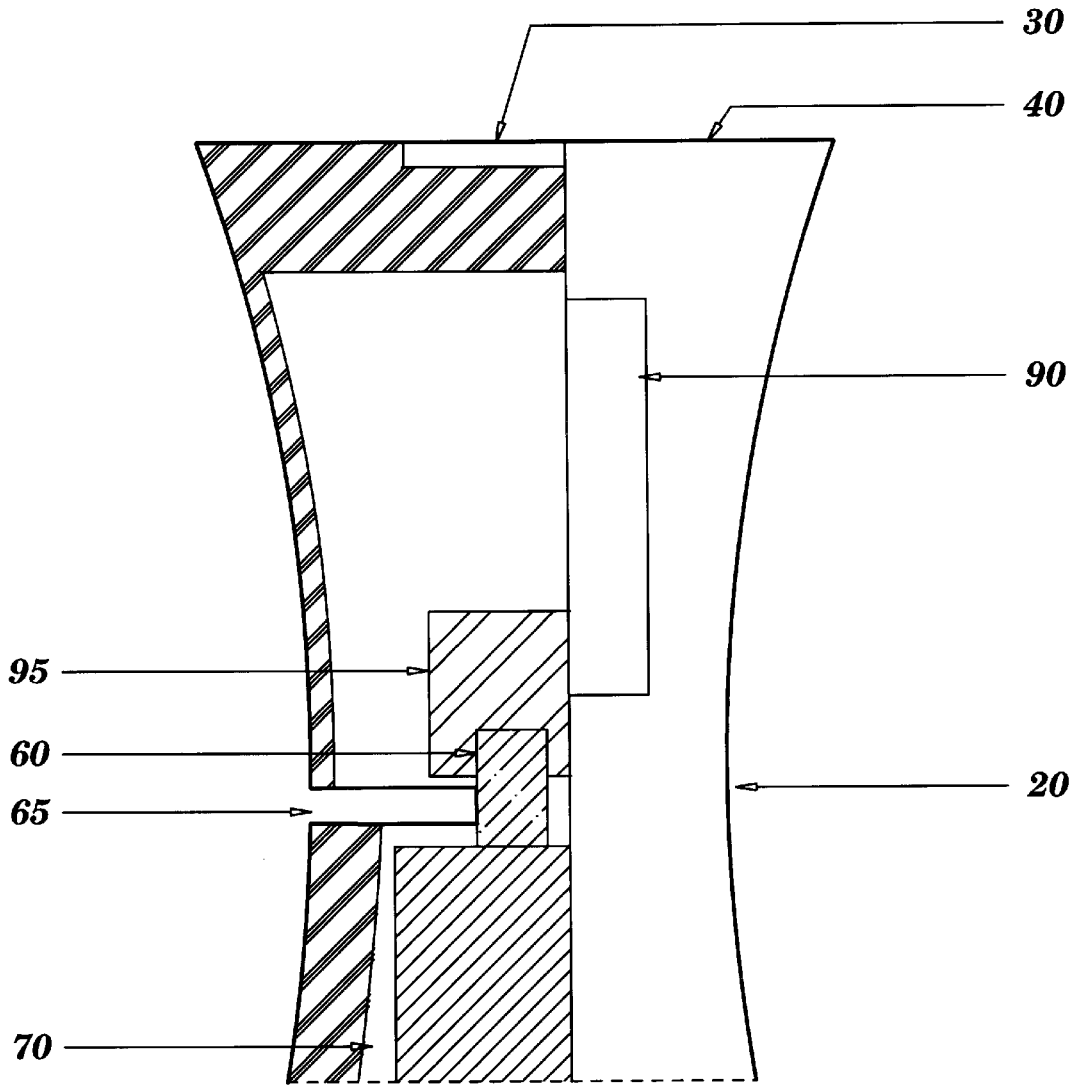
FIG. 6 is a partial sectional view taken on line 6—6 of the alternative embodiment shown in FIG. 5.

In FIG. 6, actuator means 90 comprises a downwardly extending stem 95 for actuating defensive fluid means 60. As further demonstrated in FIG. 6, upper element 20 has at least one outwardly extending hole 65 for discharge of the defensive fluid.

Figure 7:
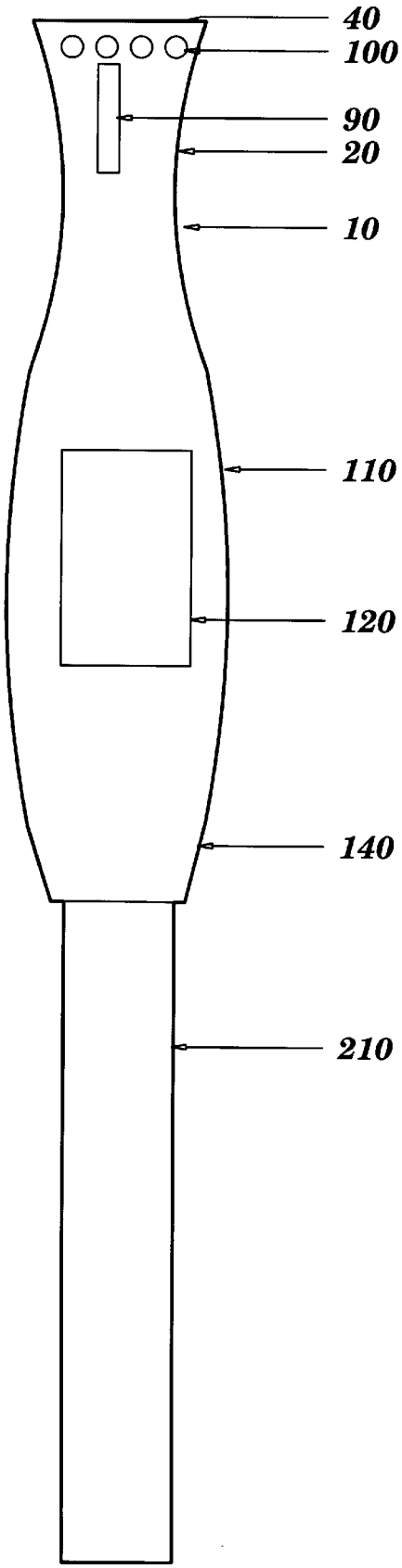
FIG. 7 is a plan view of an alternative embodiment of the protective apparatus as a hiking stick according to the present invention.

In FIG. 7, an alternative embodiment is disclosed having a walking stick 210 fixably attached to the bottom end of the present invention.

Figure 8:
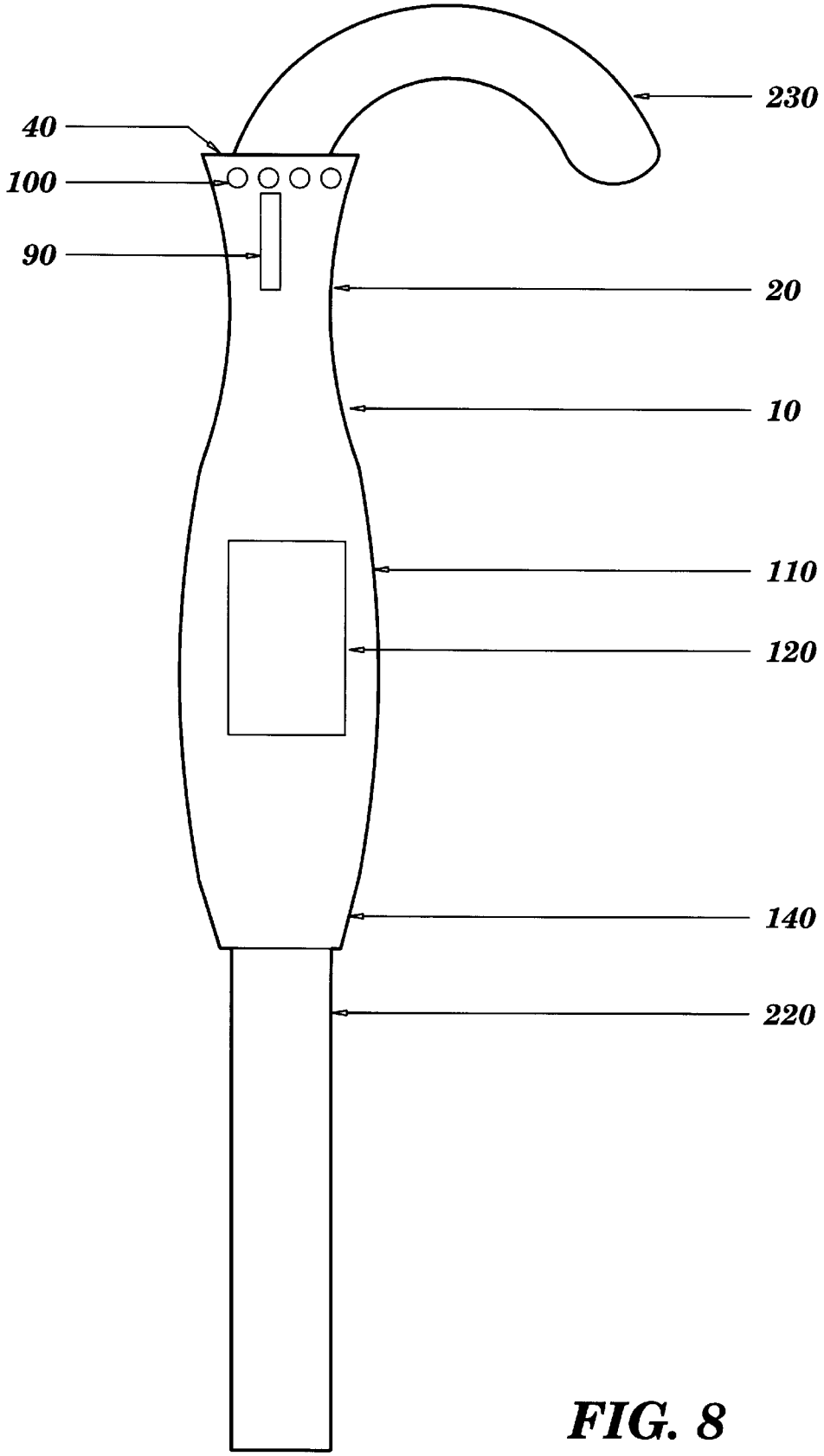
FIG. 8 is a plan view of an alternative embodiment of the protective apparatus as a walking cane according to the present invention.

In FIG. 8 another alternative embodiment is disclosed having a handle means 230 fixable attached to the top end 40 and a cane stick 220 fixable attached to the bottom end of the present invention.

Figure 9:
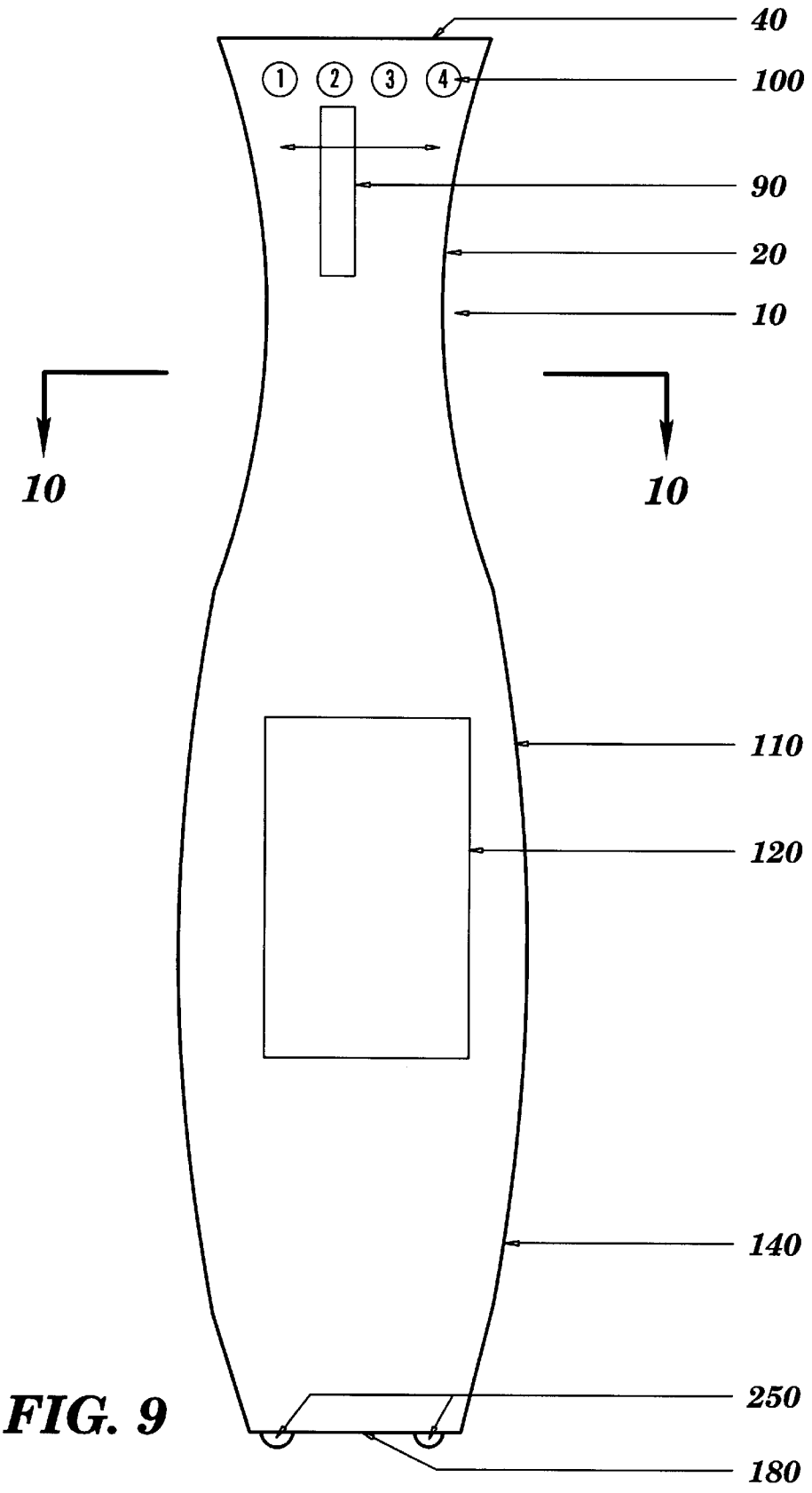
FIG. 9 is a plan view of another alternative embodiment of the protective apparatus having an integral electrical prodding device in place of a storage area.

FIG. 9 discloses an alternative embodiment comprising an electrical prodding device having two or more contact points 250 downwardly extending from the bottom end 180.

Figure 10A:
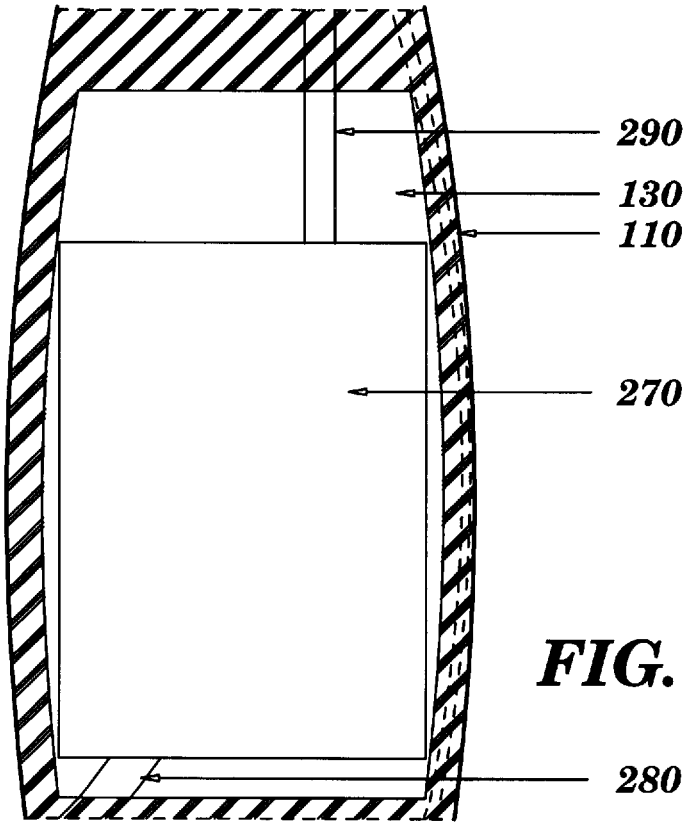
FIG. 10*a* is a partial section view of the middle section of the protective apparatus having an integral electrical prodding device.

In FIG. 10*a* an electrical prodding device 270 is disclosed having upwardly extending electrical wires 290 for connection to the switching means by and having downwardly extending electrical wires 280 for connection to contact points.

Figure 10B:
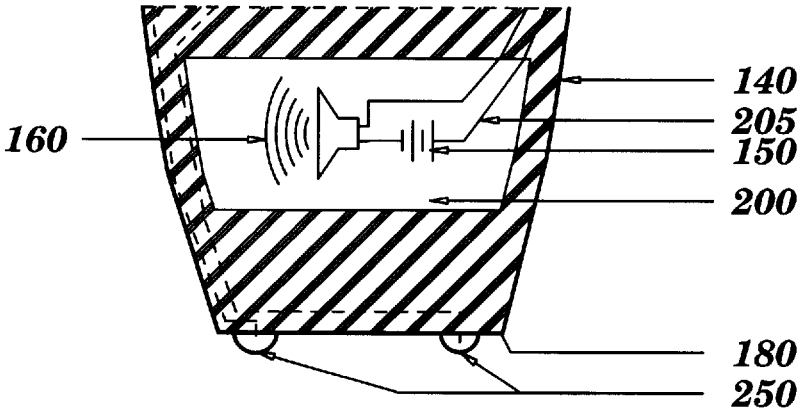
FIG. 10*b* is a partial section view of the lower section of the protective apparatus configured as an electrical prodding device.

FIG. 10*b* discloses downwardly extending contact points 250 electrically attached to said electrical prodding device.

The embodiments disclosed herein have been discussed for the purpose of familiarizing the reader with the novel aspects of the invention. Although preferred embodiments of this invention have been shown, many changes, modifications, and substitutions may be made by one having ordinary skill in the art without departing from the scope of the inventions as described in the following claims.

I claim:

1. A personal protective apparatus for protecting a user against an attacker; said apparatus comprising a hollow housing defining an elongated handgrip wherein said housing has an upper part, a middle part and a lower part, said housing further having a upper end and a bottom end;

an alarm means positioned within said handgrip for emitting an audible alarm;

a defensive fluid means positioned within said housing for discharging a defense fluid;

an activator means positioned adjacent to said upper end of said housing for selectively activating said audible alarm means, for selectively activating said defensive fluid means and for selectively activating said alarm means and said defense fluid means;

an upward extending cavity positioned within said bottom end of said hollow housing for detachably receiving a walking stick; and a storage means positioned within said middle part of said hollow housing for storing items by a user.

2. The protective apparatus of claim 1 wherein said actuator comprises:

an actuator button movable relative to said housing to selectively activate said alarm means and to selectively activate said defense fluid means wherein said button is movable between a first ready position in which said actuator button cannot be unintentionally moved to activate said defense fluid means, a second ready position in which said actuator button is movable to activate said alarm means and said defensive fluid means, a third ready position in which said actuator button is movable to activate said defensive fluid means and a fourth ready position in which said actuator button is movable to load and/or unload said defensive fluid means.

3. The protective apparatus of claim 1 wherein said alarm means comprises an electrical siren, a battery, and an electrical switch means for electrically connecting said siren to said battery upon closure thereof.

4. The protective apparatus of claim 1 wherein said housing has at least one opening adjacent to said lower part defining a speaker grill for projecting the sound of said siren away from said housing.

5. The protective apparatus of claim 1 wherein said defense fluid means comprises an aerosol canister containing a pressurized defensive fluid selected from the group consisting of tear gas, pepper gas and MACE®.

6. The protective apparatus of claim 1 wherein said aerosol canister comprises an upwardly extending release valve and said actuator button comprises a downwardly extending post having a cavity therein for receiving said defensive fluid means and wherein said defensive fluid means is opened to discharge said defensive fluid when said actuator button is moved vertically downward such that said post depresses said defensive fluid means.

7. The protective apparatus of claim 1 wherein a walking stick is fixedly connected to said bottom end of said hollow housing.

8. The protective apparatus of claim 1 wherein said housing has at least one opening adjacent to said upper part defining a discharge means for projecting the defense fluid means away from said housing.

9. A personal protective apparatus for protecting a user against an attacker; said apparatus comprising a hollow housing defining an elongated handgrip wherein said handgrip has an upper part, a middle part and a lower part, said handgrip further having an upper end and a bottom end;

said upper end further having a handle fixedly attached to said housing;

an alarm means positioned within said handgrip for emitting an audible alarm;

a defensive fluid means positioned within said housing for discharging a defense fluid;

an activator means positioned within said handle of said housing for selectively activating said audible alarm means, for selectively activating said defensive fluid means and for selectively activating said alarm means and said defense fluid means;

a cane body fixedly connected to said bottom end of said hollow housing; and a storage means positioned within said middle part of said hollow housing for storing items by a user.

10. A personal protective apparatus for protecting a user against an attacker; said apparatus comprising a hollow housing defining an elongated handgrip wherein said housing has an upper part, a middle part and a lower part, said housing further having a upper end and a bottom end;

an alarm means positioned within said handgrip for emitting an audible alarm;

a defensive fluid means positioned within said housing for discharging a defense fluid;

an electrical prodding device positioned within said middle part of said hollow housing;

an activator means positioned adjacent to said upper end of said housing for selectively activating said audible alarm means, for selectively activating said alarm means and said defense fluid means, and for selectively activating said electrical prodding device;

two or more downwardly extending contact points positioned on said bottom end of said hollow housing for discharge of said electrical prodding device.

* * * * *

UNITED STATES PATENT AND TRADEMARK OFFICE

CERTIFICATE OF CORRECTION

PATENT NO. : 5,839,461
DATED : November 24, 1998
INVENTOR(S) : Harvey F. Lambeth, Jr.

It is certified that error appears in the above-indentified patent and that said Letters Patent is hereby corrected as shown below:

On the title page item [76], should read -- HARVEY E. LAMBETH, JR. --

Signed and Sealed this

Fifth Day of October, 1999

*Attest:*

*Attesting Officer*

Q. TODD DICKINSON

*Acting Commissioner of Patents and Trademarks*